US005754385A

United States Patent [19]

Altmaier et al.

[11] Patent Number: 5,754,385

[45] Date of Patent: May 19, 1998

[54] OVERVOLTAGE PROTECTION ELEMENT

[75] Inventors: Holger Altmaier, Steinheim; Klaus Scheibe; Eberhard Lehmann, both of Kiel, all of Germany

[73] Assignee: Phoenix Contact GmbH & Co., Blomberg, Germany

[21] Appl. No.: 541,758

[22] Filed: Oct. 10, 1995

[30] Foreign Application Priority Data

| | | | |
|---|---|---|---|
| Oct. 7, 1994 | [DE] | Germany | 44 359 68.3 |
| Oct. 17, 1994 | [DE] | Germany | 44 370 94.6 |
| Nov. 9, 1994 | [DE] | Germany | 44 397 30.5 |

[51] Int. Cl.[6] ..... H01C 7/12

[52] U.S. Cl. ..... 361/118; 361/111; 361/130

[58] Field of Search ..... 361/2, 91, 56, 361/13, 117, 111, 118, 212, 220, 129, 130

[56] References Cited

U.S. PATENT DOCUMENTS

| | | | |
|---|---|---|---|
| 3,978,300 | 8/1976 | Slade | 200/147 R |
| 4,550,299 | 10/1985 | Bachler | 335/195 |
| 5,136,451 | 8/1992 | Valdemarsson et al. | 361/2 |

*Primary Examiner*—Brian K. Young
*Assistant Examiner*—Sally C. Medley
*Attorney, Agent, or Firm*—Sixbey, Friedman, Leedom & Ferguson; David S. Safran

[57] ABSTRACT

An overvoltage protection element for discharge of transient overvoltages, with two electrodes (2), a disruptive discharge-spark air spark gap (3) which acts between the electrodes (2), and a housing (4) which holds electrodes (2). Each electrode (2) has a connecting leg (5) and an arcing horn (6) which runs preferably at an acute angle to connecting leg (5). The arcing horns (6) are spaced from one another and together form the disruptive discharge-spark air gap. The overvoltage protection behavior of the overvoltage protection element (1) is improved by there being an arc splitter arrangement (23) which has a plurality of arc splitters (22) within housing (4) as well as by causing the disruptive discharge-spark air gap to be curved or angled through an arc of at least 10° and less than 180°.

25 Claims, 8 Drawing Sheets

FIG. 1
(PRIOR ART)
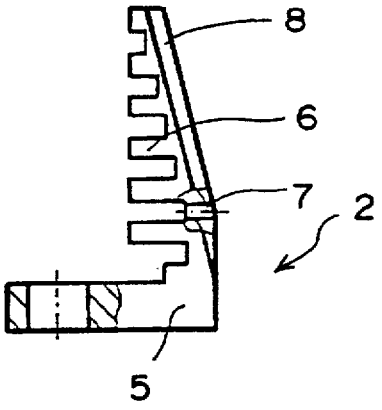
FIG. 2
(PRIOR ART)
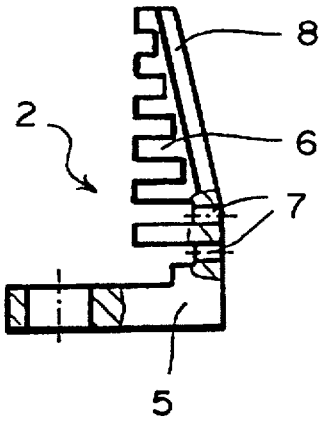
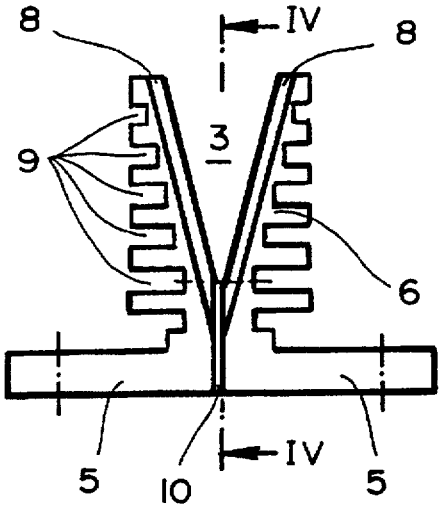
FIG. 3
(PRIOR ART)
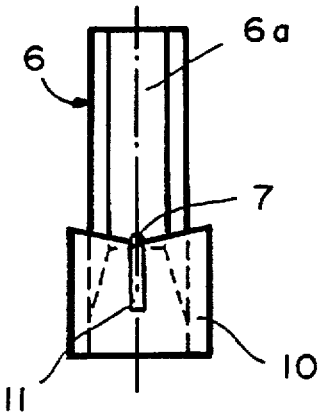
FIG. 4
(PRIOR ART)

FIG. 5
(PRIOR ART)
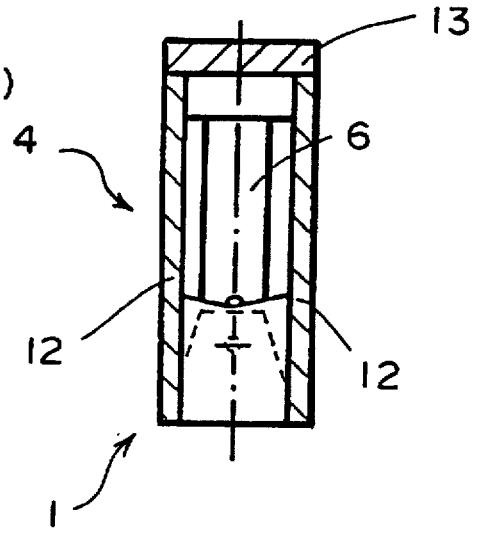
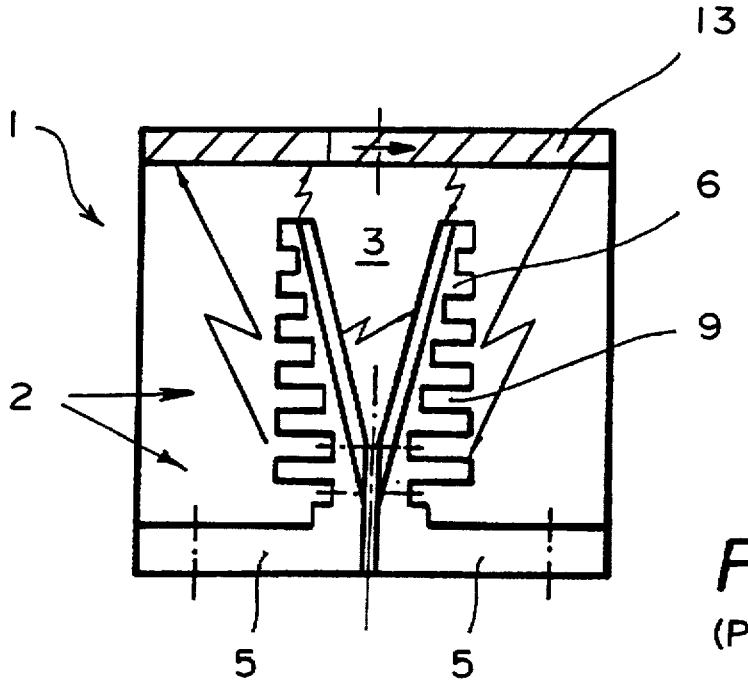
FIG. 6
(PRIOR ART)

OVERVOLTAGE PROTECTION ELEMENT

BACKGROUND OF THE INVENTION

1. Field of the Invention

The invention relates to an overvoltage protection element for discharge of transient overvoltages with two electrodes, a disruptive discharge-spark air gap which acts between the electrodes, and a housing which holds the electrodes, each electrode having a connecting element, preferably a connecting leg, and an arcing horn which runs preferably at an acute angle to the connecting element, and the arcing horns of the two electrodes being spaced from one another forming between them the disruptive discharge-spark air gap.

2. Description of Related Art

Electrical, but especially electronic, measurement, control, regulation and switching circuits, primarily also telecommunications equipment and systems, are sensitive to transient overvoltages, as could occur especially due to atmospheric discharges, but also by short circuits and switching operations in power supply networks. This sensitivity has increased to the degree to which electronic components, especially transistors and thyristors, are used; primarily integrated circuits which are being increasingly used are highly endangered by transient overvoltages.

In addition to the overvoltage protection element on which the invention is based (see German Patent DE 37 16 997 C2), i.e., one with an a disruptive discharge-spark air gap, there are overvoltage protection elements with an air-flashover spark gap in which therefore a creeping discharge occurs upon response (see German Patent Application Nos. DE 27 18 188, DE 29 34 236 and DE 31 01 354).

Overvoltage protection elements of the type on which the invention is based, therefore, those with a disruptive discharge-spark air gap compared to overvoltage protection elements with an air-flashover spark gap now have the advantage of higher surge carrying capacity, but the disadvantage of higher and also not especially constant operating voltage.

At this point, different overvoltage protection elements with a disruptive discharge-spark air gap have been developed which have been improved with reference to the operating voltage (see German Patent Application Nos. DE 41 41 681, DE 41 41 682, and DE 42 44 051).

A commonly-owned, older patent application of the present inventors and one other inventor (U.S. Pat. No. 5,604,400 and published German counterpart application DE 44 02 615), discloses an overvoltage protection device having the object of improving the initially described overvoltage protection element overall in its voltage protection behavior, especially also with respect to the operating voltage, the lightning stroke current and the network follow current carrying behavior and the network follow current extinction behavior.

A first teaching according to our noted older patent application is that the arcing horns of the electrodes are provided with a hole in their areas bordering the connecting legs. These holes provide for initiation of improved ignition and arc running behavior at the instant of operation of the overvoltage protection element, especially the arc near the holes "is started" by thermal-atmospheric blow out.

The second teaching according to our aforementioned older patent application is that an ignition aid which triggers a creeping discharge is located between the opposite ends of the connecting legs of the two electrodes. In the overvoltage protection element detailed according to this teaching, more or less in the narrowest part of the disruptive discharge-spark air gap, therefore, where operation takes place, an auxiliary spark gap is integrated. This auxiliary air-flashover spark gap has a relatively constant and mainly lower operating voltage than the disruptive dischargespark air gap used as the actual overvoltage protection. Once triggered, at a relatively constant low operating voltage, the ignited auxiliary air-flashover spark gap leads to "sudden" ignition of the disruptive discharge-spark air gap with relatively high current carrying capacity, therefore, high lightning stroke current and network follow current carrying capacity. In this embodiment, therefore, the advantages of a disruptive discharge-spark air gap and an air-flashover spark gap are realized and their disadvantages eliminated.

A third teaching according to our earlier patent application is that the housing is at least partially formed of a plastic which does not release carbon during combustion, or is at least partially lined with this plastic. Normally, the installation of electrodes which form a disruptive discharge-spark air gap with arcing horns in a relatively small plastic housing which releases carbon when heated or burned is problematic. In particular, based on the very hot arc which is formed after operation, combustion of the plastic and thus enormous release of carbon occur. The leads to fouling of the electrodes and loss of insulation resistance. In addition, the enormous carbon portion in the gas mixture also adversely affects the extinction behavior of the electrodes. The above described disadvantages, of course, do not occur when the housing is at least partially made of a plastic which does not release carbon when heated or burned, e.g., POM, or if the housing is at least partially lined with this plastic.

A fourth teaching according to our older patent application is that the side walls of the housing are drawn relatively near to the arcing horns of the electrodes. By this teaching, extremely good atmospheric blow out of the arc occurs. It proceeds very quickly to the tips of the arcing horns; therefore, it does not stick in the ignition area.

A fifth teaching according to our above-mentioned prior patent application is that the housing cover which is adjacent to the arcing horns of the electrodes is made of an electrically conductive material, preferably of copper-tungsten. Then, generally, the distance between the housing cover and the ends of the arcing horns of the electrodes adjacent to the housing cover are selected such that arcs can form between the arcing horn ends adjacent to the housing cover and the housing cover.

SUMMARY OF THE INVENTION

Thus, proceeding from the prior art described above, a primary object of this invention is now to devise an overvoltage protection element that is further improved with respect to its overvoltage protection behavior.

The overvoltage protection element according to the invention has at least one arc splitter arrangement, which has preferably a host of arc splitters, within the housing. The action of the arc splitter arrangement or arc splitter arrangements which improve the overvoltage protection behavior, especially the network follow current extinction behavior, is based on the fact that the arc or arcs are resolved into a series of short partial arcs which are switched in succession, and that the sum of the partial arcs has a higher voltage requirement than the undivided arc, so that after the voltage or current becomes zero, a higher re-ignition voltage is needed than in an undivided arc. Moreover, contact of the arc or partial arcs with the relatively cold, efficiently heat conducting arc splitters causes intensive cooling, and thus, deionization of the arc plasma.

According to another teaching of the invention which is of special importance, the overvoltage protection element according to the invention has a disruptive discharge-spark air gap that is curved and/or angled, so as to, therefore, be more or less "beak-shaped". It has been surprisingly found that, based on the curved and/or angled shape of the disruptive discharge-spark air gap, an overvoltage protection element that is even more improved with respect to its overvoltage protection behavior results. Tests have shown that based on the described shape of the disruptive discharge-spark air gap, the plasma between the two arcing horns is directly and very quickly blown out, so that, for this reason, a disruptive spark gap which can extinguish high network follow currents and which can carry high lightning stroke currents, and thus is a much improved overvoltage protection element, results. Due to the rapid blowout, "sticking" of the arc in the ignition area is essentially no longer possible.

In the following, the teaching of the invention is explained in detail with reference to the accompanying drawings, and in conjunction with overvoltage protection elements in which the teachings of our older patent application are realized.

BRIEF DESCRIPTION OF THE DRAWINGS

FIG. 1 shows a side view of a preferred first embodiment of an electrode of an overvoltage protection element according to our prior patent application;

FIG. 2 shows a side view of a preferred second embodiment of an electrode of an overvoltage protection element according to the noted prior patent application;

FIG. 3 shows a side view of two electrodes which together form the disruptive discharge-spark air gap in accordance with the noted prior application;

FIG. 4 shows a section through the electrodes of FIG. 3 taken along line 4—4 therein;

FIG. 5 schematically shows a cross section through a preferred embodiment of an overvoltage protection element of the noted prior patent application;

FIG. 6 shows a longitudinal section through the overvoltage protection element according to FIG. 5;

DETAILED DESCRIPTION OF THE PREFERRED EMBODIMENTS

Figure 7:
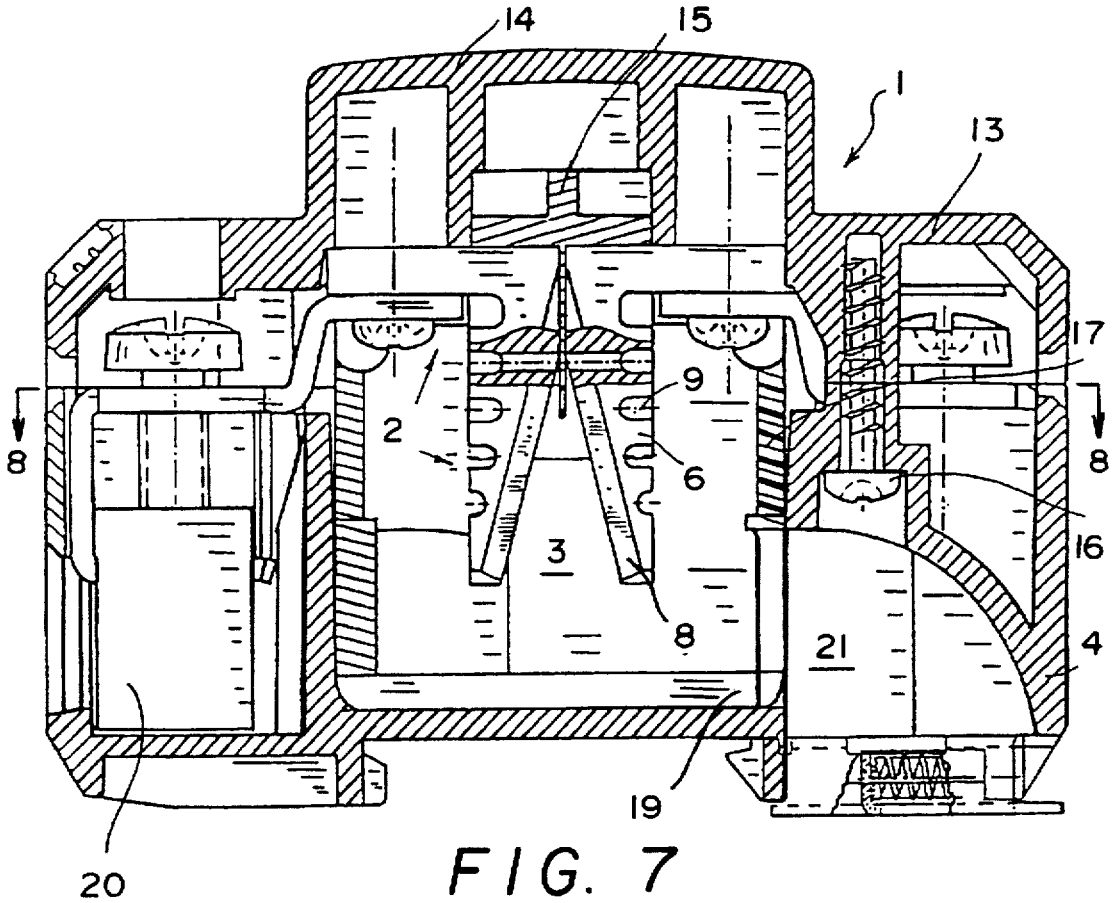
FIG. 7 (PRIOR ART)
FIG. 7 shows a longitudinal section through a detailed preferred embodiment of an overvoltage protection element according to the noted prior patent.

The overvoltage protection element 1 shown in FIGS. 1 through 12 is used to discharge transient overvoltages and to limit impulse currents, and its essential structure comprises two electrodes 2, a disruptive discharge-spark air gap 3 which is active between electrodes 2, and a housing 4 which holds the electrodes 2. Each electrode 2 is essentially L-shaped having a connecting leg 5 and an arcing horn 6 which runs at an acute angle with respect to the connecting horn 5. The arcing horns 6 of the electrodes 6 are spaced at a distance from one another with facing surfaces 6*a* thereof, together, forming disruptive discharge-spark air gap 3 between them.

As FIGS. 1–3, 6 and 11 show, the acute angle between connecting leg 5 and arcing horn 6 relates to the surface 6*a* of arcing horn 6 which forms one side of the disruptive discharge-spark air gap 3. Because arcing horns 6 of electrodes 2 run in the aforementioned manner at an acute angle to connecting legs 5, disruptive discharge-spark air gap 3 is made acutely angled and the angle between facing surfaces 6*a* of the arcing horns 6 of electrodes 2 is preferably about 30°.

As FIGS. 1, 2, 4, and 5 show, the arcing horns 6 of the electrodes 2 are provided with holes 7 which run parallel to connecting legs 5 and which, in the embodiments shown, are provided in a longitudinal center plane of the arcing horns 6 of electrodes 2 (see, especially, FIGS. 4 and 5) near the connecting legs 5.

In the electrode 2 of the overvoltage protection element 1 shown in FIG. 1, arcing horn 6 is provided with single hole 7. Conversely, FIG. 2 shows a modified form of electrode 2 in which arcing horn 6 has a pair of holes 7 provided on above the other; relative to the hole 7 in electrode 2 according to FIG. 1, the additional hole 7 is below the hole 7 which corresponds to that of the electrode 2 according to FIG. 1.

Incidentally, it can be seen in the drawings that, in the embodiment shown, the surface 6*a* of the arcing horns 6 of electrodes 2 are provided with a bevel 8 on both sides, so that the sides facing one another are made laterally convex. Additionally, the sides of the arcing horns 6 which face away from one another are provided with slots which run transversely to the longitudinal extension of arcing horns 6; instead of slots 9 which run transversely, as shown, those which run lengthwise are also possible. The beveling of the arcing horns 6 of electrodes 2 prevents wearing of the material on the edges of arcing horns 6. This measure of making the arcing horns 6 of electrodes 2 convex on their sides facing one another leads to formation of the arc, which arises after operation of overvoltage protection element 1, preferably, in a longitudinal center plane of the arcing horns 6 and leads to running of the arc formed therealong to the ends or tips of arcing horns 6. The slots 9 provided on the sides of the arcing horns 6 that face away from one another achieve the result that the current up to the bottom bend of the arc must exactly reproduce the outline of the V-shaped disruptive discharge-spark air gap 3. This yields on opposite electrode 2 magnetic blow out of the arc at its base. Slots 9, incidentally, have the advantage that the remaining material functions as an especially effective cooling body; therefore at the same time arcing horns 6 or electrodes 2 are ventilated from the rear.

In the embodiments of overvoltage protection elements 1 shown in the figures, between the opposite ends of connecting legs 5 of two electrodes 2, there is an ignition aid 10 which initiates a creeping discharge and which, preferably, is formed of an insulating material which in a change of state, for example, when heated or burned, does not release carbon to a degree which has any adverse effect, and projects only slightly, preferably 0.1 mm or so, into the disruptive discharge-spark air gap 3 formed by the arcing horns 6 of the electrodes 2; in fact, ignition aid 10 projects to the disruptive discharge-spark air gap to a point corresponding to the center of the holes 7. Incidentally, ignition aid 10 is made V-shaped on its side facing into the disruptive discharge-spark air gap 3, as shown in FIGS. 4 and 5, and is provided with a narrow slot 11 which opens into the disruptive discharge-spark air gap 3. The slot 11 in the ignition aid 10 has a positive effect on the operating voltage.

FIGS. 5–7 through 12 show that, in the embodiment of overvoltage protection element 1 shown, special measures are taken also with reference to housing 4. It holds specifically, but is not shown, that housing 4 is formed partially of a plastic which when heated or burned does not release carbon, e.g., POM, or which is partially lined with such a plastic. The problems described earlier which occur when the housing is made of a plastic which releases carbon when heated or burned, are therefore eliminated.

Incidentally, FIGS. 5 and 6 as well as 7–12 show that, in the embodiments of overvoltage protection elements 1 shown, side walls 12 of housing 4 adjoin the arcing horns 6 of electrodes 2. In this way, extremely good running behavior of the arc occurs; it runs very quickly to the tips of arcing horns 6.

For the embodiments of overvoltage protection elements 1 shown in FIG. 5, 6 and 11, 12, it also holds that housing cover 13, adjacent to arcing horns 6 of electrodes 2, is made of electrically conductive material, preferably of burn-proof material, especially copper-tungsten. In this case, then, the distance between the ends of the arcing horns 6 of electrodes 2 adjacent to housing cover 13 and the housing cover 13 is selected such that arcs can form between the ends of arcing horns 6 adjacent to housing cover 13, and housing cover 13.

Due to the above described measures, the arc which forms after operation of the overvoltage protection element 1 first migrates from the ignition region to the tips of arcing horns 6. Then, between the tips of arcing horns 6 and housing cover 13 which consists of electrically conductive material, two arcs form. The conductor loop which builds up in this process, at this point, provides for the two arcs being driven behind arcing horn 6. Overall, this results in two arcs forming which provide for a high arc burning voltage at the network follow current, so that the extinction behavior for the network follow current has changed considerably, specifically a quasi-short circuit-proof discharge arrangement has formed.

It should be pointed out that, in the embodiment of overvoltage protection element 1 to which an electrode according to claim 2 belongs, therefore, one in which each arcing horn 6 has two holes 7 located one above the other, the lower second hole 7 then takes effect when ignition aid 10 is burned down between the connecting legs 5 of electrodes 2. Second hole 7 is, therefore, used more or less as a safety for overvoltage protection element's 1 functioning even in such a case.

While, in FIGS. 5 and 6 as well as 11 and 12, preferred embodiments of the overvoltage protection elements 1 are shown only schematically, FIGS. 7–10 show in structural detail one preferred embodiment of the overvoltage protection element 1. Here, it should be pointed out first that, in FIGS. 1–6, electrodes 2 are shown such that disruptive discharge-spark air gap 3 opens from top to bottom. Incidentally, in the embodiment of overvoltage protection element 1 shown in FIGS. 7–10, electrodes 2 with arcing horns 6 and ignition aid 10 are executed essentially as has been described previously, in particular in conjunction with FIGS. 1–6, such that details in this regard in conjunction with FIGS. 7–10 are superfluous. FIGS. 7–10 also show mainly structural details with reference to housing 4.

Figure 10:
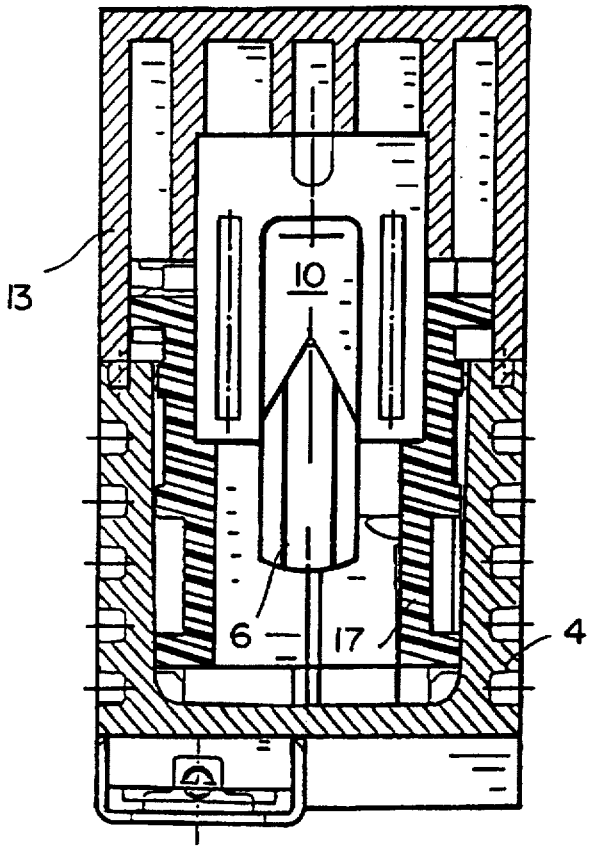
FIG. 10 (PRIOR ART)
FIG. 10 shows a section through the overvoltage protection element taken along line 10—10 in FIG. 8.

As FIGS. 7 and 10 show, a specially configured housing cover 13 is connected to housing 4. This housing cover 13 has a dome-shaped piece 14 into a which holder 15 which accommodates electrodes 2 is inserted. Housing cover 13 is connected by inside screws 16 to actual housing 2.

Furthermore, it is detailed above that housing 4 is made at least partially of a plastic which when heated or burned does not release any carbon or is at least partially lined with this plastic, e.g., POM. In the embodiment shown in FIGS. 7–10, the second alternative is accomplished; therefore, housing 4 has a lining 17 of a plastic which does not release carbon when it is heated or it burns.

In conjunction with FIG. 5, it is, furthermore, seen that side walls 12 of housing 4 laterally adjoin the arcing horns 6 of electrodes 2, by which good running behavior of the arc occurs. The embodiment of overvoltage protection element 1 shown in structural detail in FIGS. 7–10 achieves the same good running behavior of the arc by the fact that the disruptive discharge-spark air gap 3 formed by arcing horns 6 is confined laterally by limiting elements 18.

In conjunction with FIGS. 5 and 6, it is furthermore explained also above that housing cover 13, adjacent to arcing horns 6 of electrodes 2, is made of an electrically conductive material, and the distance between the ends of arcing horns 6 of electrodes 2 adjacent to housing cover 13, and housing cover 13 is selected such that arcs can form between the ends of arcing horns 6 adjacent to housing cover 13, and housing cover 13. The same result is achieved in the embodiment shown in structural detail in FIGS. 7–10 by a liner 19 of electrically conductive material, in turn, preferably of burn-proof material, being provided in housing 4 opposite the ends of arcing horns 6 of electrodes 2.

Figure 8:
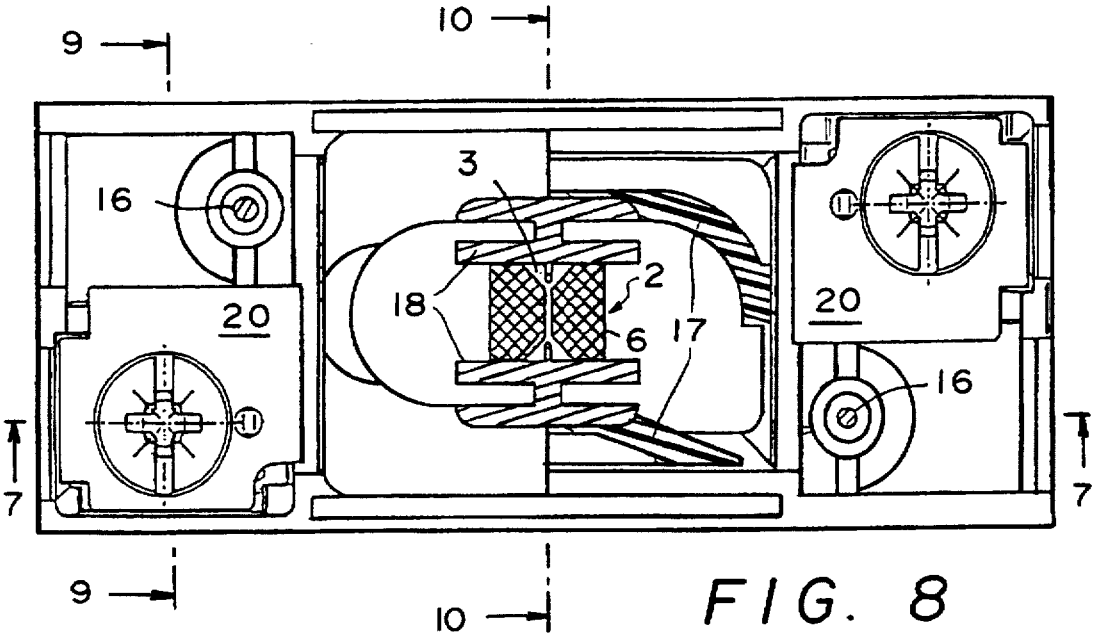
FIG. 8 (PRIOR ART)
FIG. 8 is cross-sectional view of the overvoltage protection element taken along line 8—8 in FIG. 7.
Figure 9:
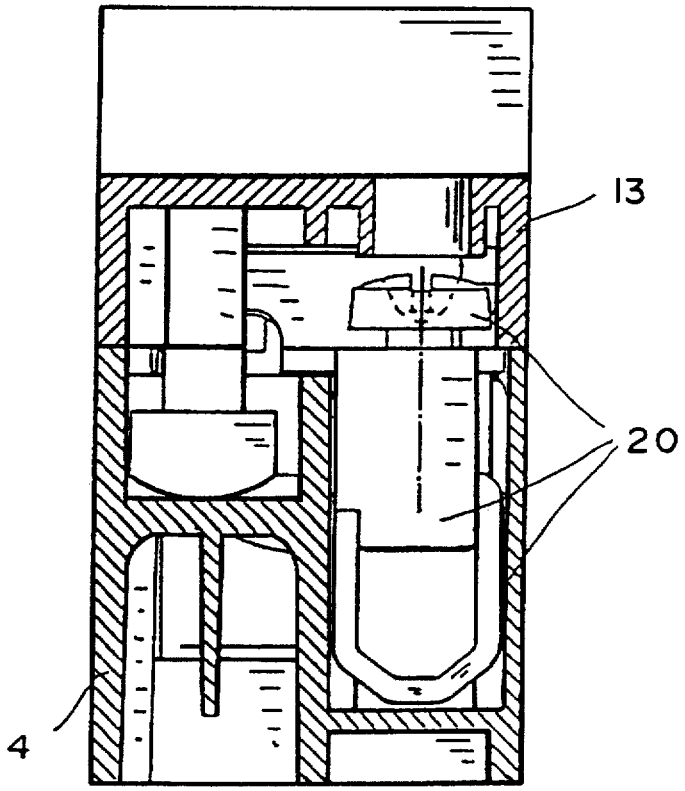
FIG. 9 (PRIOR ART)
FIG. 9 shows a section through the overvoltage protection element taken along line 9—9 in FIG. 8.

Incidentally, FIGS. 7–10, especially FIGS. 7 through 9, show that housing 4, and accordingly also housing cover 13, are asymmetrical. That is, as can be seen from FIG. 8, the location of screws 16 by which housing cover 13 is connected to housing 4 and of connecting elements 20 for connecting electric lines (not shown) are reversed on one side of the central vertical plane represented by line 10–10 as compared to that on the other side of that plane. Under screws 16 with which housing cover 13 is joined to housing 14, blow out openings 21 are provided.

Figure 11:
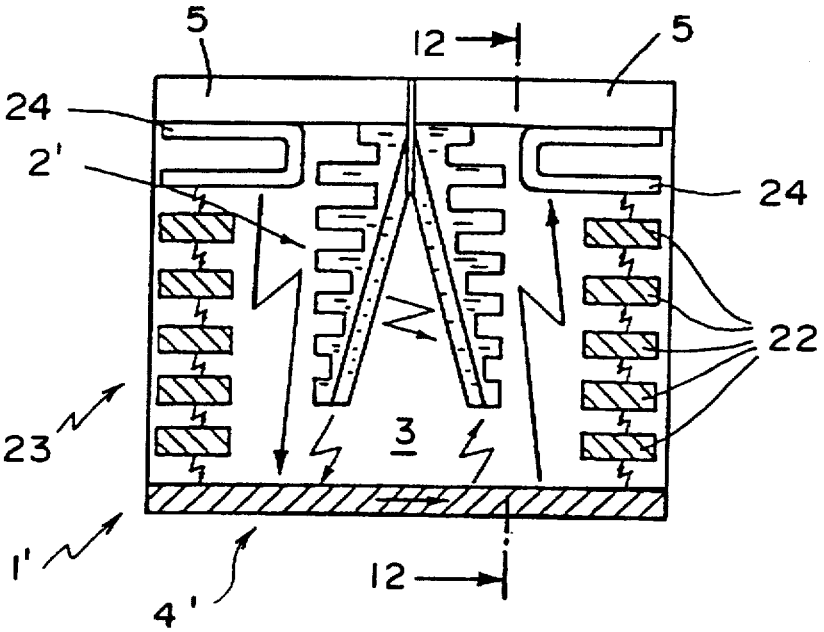
FIG. 11 shows a longitudinal section through a preferred embodiment of an overvoltage protection element according to the present invention.
Figure 12:
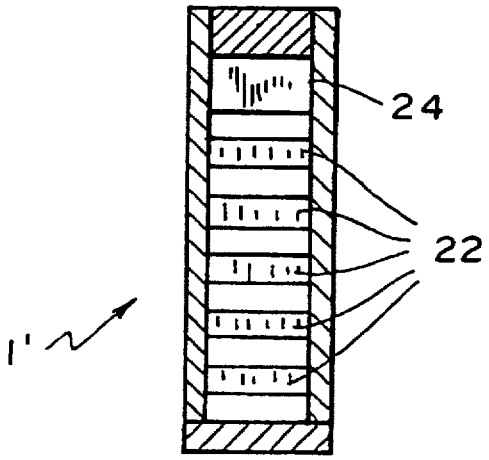
FIG. 12 shows a section through the overvoltage protection element taken along line 12—12 in FIG. 11.
Figure 17:
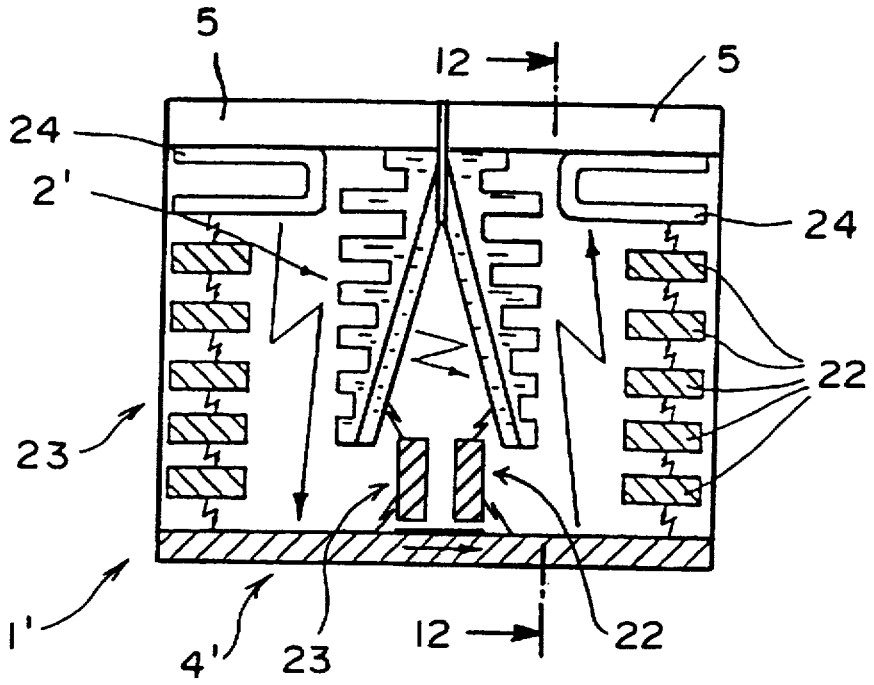
FIG. 17 is a cross-sectional view of another embodiment of the invention having three arc splitter arrangements.

As FIG. 11 shows, within housing 4' of overvoltage protection element 1' according to the present invention, there is at least one arc splitter arrangement 23 which comprises a plurality of arc splitters 22. In fact, there are two arc splitter arrangements 23, each of which is located on a side of a respective one of the electrodes 2 that faces away from air gap 3. This embodiment has the advantage that the lightning impulse current is decoupled from the network follow current. Of course, it is also possible to provide the overvoltage protection element according to the invention with three arc splitter arrangements, specifically with one arc splitter arrangement opposite the electrode ends distant from the connecting elements 5, and with two arc splitter arrangements on the sides of the electrodes facing away from one another (FIG.17).

To split the arc, forces are necessary which drive the arc into the arc splitter arrangements 23. Therefore, arc splitters 22 of ferromagnetic material, preferably iron, are used. The occurrence of forces which drive the arc into arc splitter arrangements 23 when using arc splitters 22 of ferromagnetic material is due to the action of the magnetic flux surrounding the conductors through which current is flowing, being caused to flow, as much as possible, through the iron arc splitters 22 which conduct magnetically much better than air; the arc is, therefore, attracted by arc splitter arrangement 23 with arc splitters 22 of ferromagnetic material.

Incidentally, it is recommended that iron arc splitters 22 be provided with a surface coating of corrosion-resistant material, preferably silver or nickel.

As FIG. 11 shows, the arc splitters 22 of overvoltage protection element 1' according to the invention have a rectangular cross section with a ratio of length to width of roughly 4:1 to roughly 2:1, preferably roughly 3:1.

Incidentally, FIG. 11 shows a preferred embodiment of overvoltage protection element 1' according to the invention inasmuch as the connecting elements of electrodes 2 constituted by connecting legs 5 are each provided with a current loop 24 associated with the arc splitter 22 next to the respective connecting leg 5. Current loops 24 are U-shaped with an open side pointing away from the electrodes 2. In this way, the forces which are caused by flowing current and which occur without this measure are "neutralized.

FIGS. 13–16 show two different embodiments of overvoltage protection elements 1' according to the invention. Both embodiments, first of all, have the same structure as the embodiments described so far. In this respect, reference is therefore made to the preceding description.

For the embodiments of overvoltage protection element 1' according to the invention shown in FIGS. 13 through 16, it is significant that the disruptive discharge-spark air gap 3 is curved or angled in a manner making the disruptive discharge-spark air gap 3 more or less "beak-shaped". By this special configuration of the disruptive discharge-spark air gap 3, in which the curve or angle runs through at least 10° of arc but less than 180° of arc, preferably about 90°, it is ensured that, on the one hand, the plasma formed between arcing horns 6 is blown out directly and quickly, and on the other hand, as the result thereof that the arc is extinguished quickly, reliably and efficiently. Overall, the configuration of the arc gap according to the invention yields a disruptive arc gap which can extinguish the network follow current and which can carry a high lightning impulse current.

In the embodiments shown in FIGS. 13–16, due to the beak shape, arcing horn **6*a* is larger and arcing horn 6*b* is smaller. The structural configuration of disruptive discharge-spark air gap 3 is such that, the larger arcing horn 6*a* has a lower straight area which runs roughly at a right angle to connecting leg 5 and which is joined to an arc-shaped upper area. Smaller arcing horn 6*b* is shaped accordingly having a lower straight area to which an arc-shaped upper area is joined. It goes without saying that the beak shape can of course also be made differently. Thus, for example, the lower straight areas can be completely omitted and solely arc-shaped areas provided. The lower straight area of larger arcing horn 6*a* would not have to run at a right angle to connecting leg 5 either. Finally, instead of the arc-shaped areas there could also be one or more straight areas. In any case, it should be guaranteed that the lower area of disruptive discharge-spark air gap 3** encloses an angle about 10° to 40°, preferably 20° to 30°. The embodiments shown in the figures are offered as examples where there is a continuous transition between the individual aforementioned areas, and unintentional material wear on edges or steps cannot occur.

Figure 13:
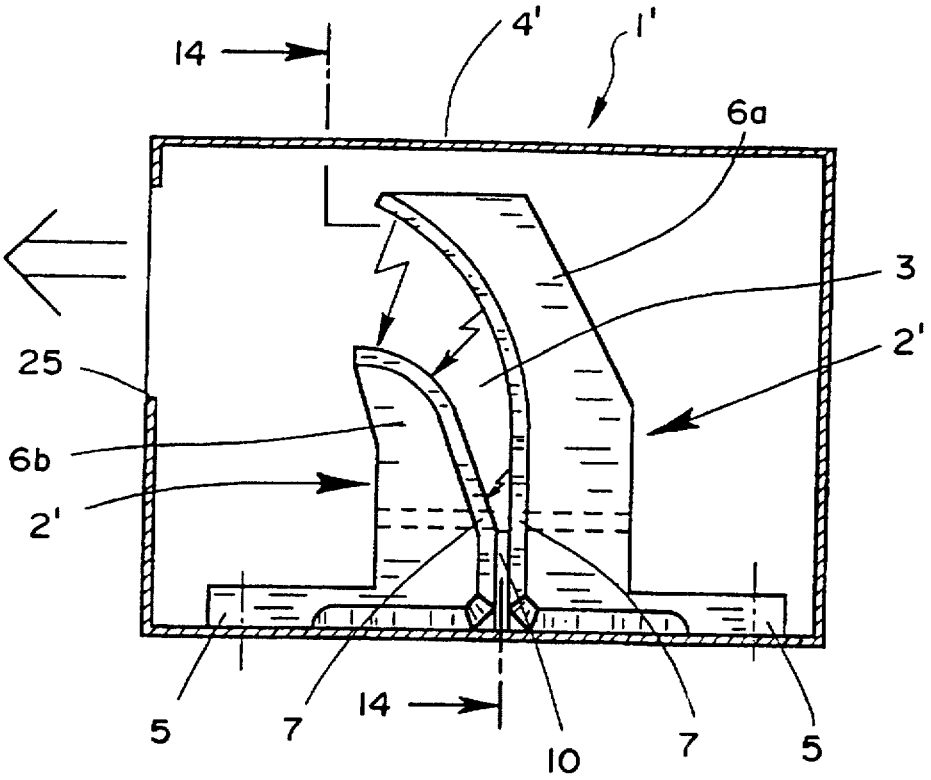
FIG. 13 shows a longitudinal section through another embodiment of an overvoltage protection element according to the present invention.
Figure 14:
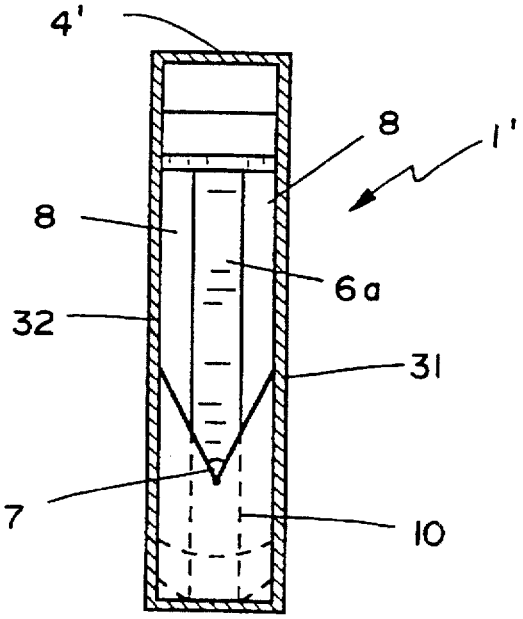
FIG. 14 shows a section through the overvoltage protection element in FIG. 13 along line 14—14 in FIG. 13.
Figure 15:
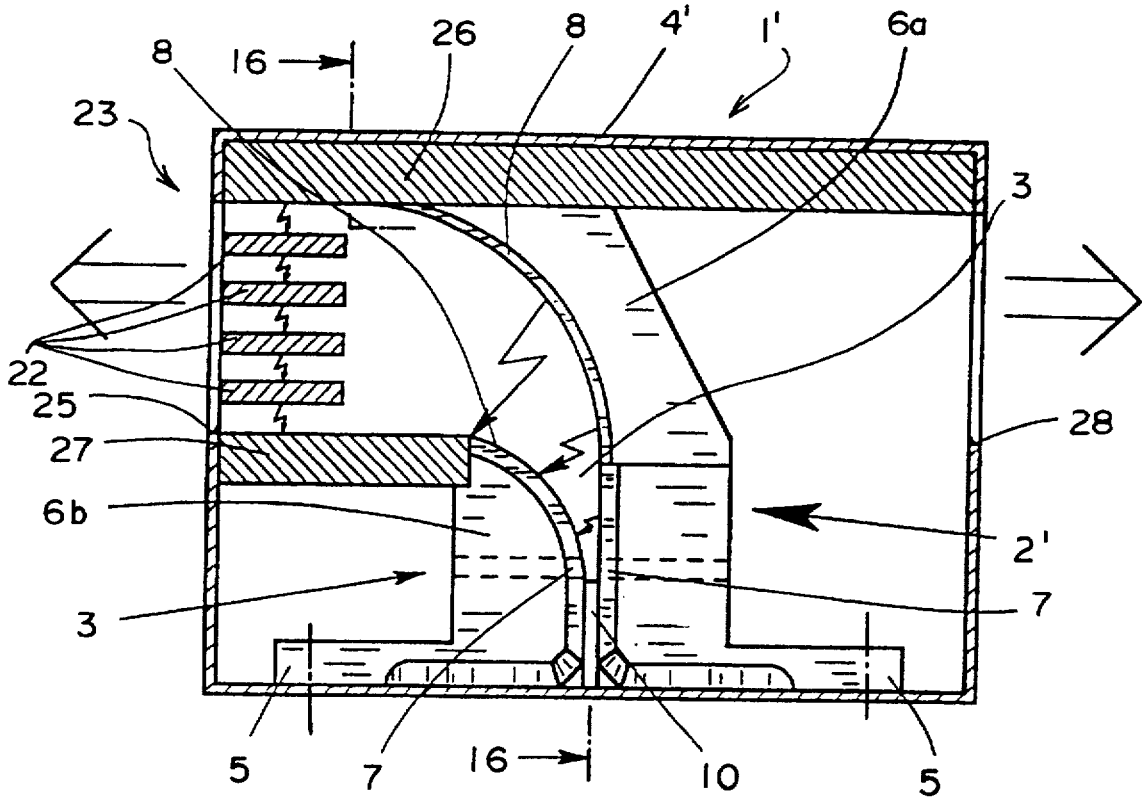
FIG. 15 shows a longitudinal section through an especially preferred embodiment of an overvoltage protection element according to the present invention.
Figure 16:
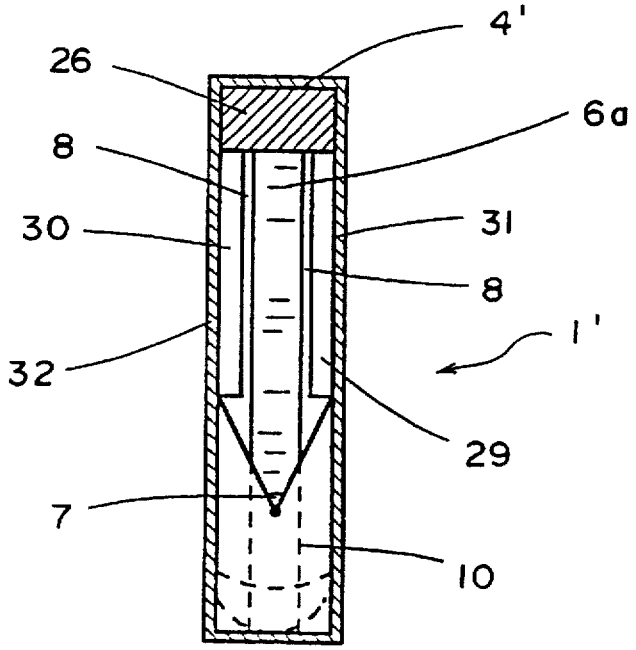
FIG. 16 shows a section through the overvoltage protection element taken along line 16—16 in FIG. 15.

The two embodiments shown, on the one hand in FIGS. 13 and 14, and on the other in FIGS. 15 and 16, each share another common feature, i.e., that disruptive discharge-spark air gap 3 opens into a blow out opening 25 in the housing 4'. This, therefore, means that the plasma can be blown out directly via blow out opening 25 together with the exhaust gases which form.

In the embodiment shown in FIGS. 15 and 16, there is an arc splitter arrangement 23 which has a plurality of arc splitters 22 within housing 4'. Arc splitter arrangement 23 is located adjacent to the disruptive discharge-spark air gap 3, preferably in the area of blow out opening 25 and directly in front of it. Arc splitters 22, which preferably have a rectangular cross section, are made of ferromagnetic material, preferably iron. For reason of "extinction engineering", it is a good idea that the arc splitters have a cross section with a ratio of length to width of roughly 4:1 to 2:1, preferably roughly 3:1. Moreover, arc splitters 22 can be provided with a surface coating of corrosion-resistant metal, preferably silver or nickel.

In addition to arc splitters 22 located in blow out opening 25, arc splitter arrangement 23 has another uppermost arc splitter 26 or an uppermost conductor and a lowermost arc splitter 27 or a lowermost conductor. In the embodiment shown in FIGS. 3 and 4, the uppermost arc splitter 26, at the same, has a potential as large the large arcing horn **6*a*, while lower arc splitter 27 has the same potential as the smaller arcing horn 6*b*. Arc splitters 26, 27 are galvanically connected to arcing horns 6*a*, 6*b* respectively. Here as well, it the transition from the larger arcing horn 6*a* to the uppermost arc splitter 26 and from the smaller arcing horn 6*b* to the lowermost arc splitter 27** should be essentially continuous.

In order to transport away as quickly and efficiently as possible the exhaust gases which form when the arc forms from housing 4', to prevent deposition in housing 4 as much as possible, in the embodiment shown in FIGS. 15 and 16, it is provided that the width of the larger arcing horn **6*a* is smaller at least in the upper area than the width of housing 4, and that an exhaust gas opening 28 is provided in housing 4 opposite blow out opening 25. Preferably, there is a slot 29, 30 on either side between the larger arcing horn 6*a* and housing 4; exhaust gas opening 28 adjoins the slots in the exhaust gas outflow direction. Overall, in the embodiment shown in FIGS. 15 and 16**, there is a bilateral discharge of the exhaust gases.

In the embodiment shown in FIGS. 13 and 14 there are no slots. In this case, side walls 31, 32 of housing 4' are adjoin the arcing horns **6*a*, 6*b*. This yields extraordinarily good running behavior of the arc; it runs very quickly to the tips of arcing horns 6*a*, 6*b***.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

We claim:

1. An overvoltage protection element for discharging transient overvoltages of the type in which a disruptive discharge-spark air gap is active between two electrodes contained in a housing, each electrode having a connecting leg and an arcing horn running at an acute angle to the connecting leg, and the arcing horns of the electrodes having spaced facing surfaces between which the disruptive discharge-spark air gap is formed, wherein two arc splitter arrangements having a plurality of arc splitters are provided within said housing; and wherein there are two arc splitter arrangements, each of which is located opposite a side of a respective one of the two electrodes which faces away from the other of said two electrodes at a distance from the respective electrode.

2. Overvoltage protection element according to claim 1, wherein the arc splitters are made of a ferromagnetic material.

3. Overvoltage protection element according to claim 2, wherein said ferromagnetic material is iron.

4. vervoltage protection element according to claim 2, wherein the arc splitters are provided with a surface coating of a corrosion-resistant metal.

5. Overvoltage protection element according to claim 4, wherein said corrosion-resistant metal is selected from the group consisting of silver or nickel.

6. Overvoltage protection element according to claim 1, wherein the arc splitters have a rectangular cross section.

7. Overvoltage protection element according to claim 6, wherein the cross section of the arc splitters has a ratio of length to width of between about 4:1 to about 2:1.

8. Overvoltage protection element according to claim 7, wherein said ratio is 3:1.

9. Overvoltage protection element according to claim 1, wherein the connecting legs of the electrodes are each provided with a current loop that is associated with one of the arc splitters, said one of the arc splitters being located next to the connecting leg.

10. Overvoltage protection element according to claim 9, wherein the current loop is U-shaped having an open side pointing away from electrodes.

11. Overvoltage protection element according to claim 1, wherein said disruptive discharge-spark air gap is curved or angled through an arc of at least 10° and less than 180°.

12. Overvoltage protection element according to claim 11, wherein said arc is 90°.

13. An overvoltage protection element for discharging transient overvoltages of the type in which a disruptive discharge-spark air gap is active between two electrodes contained in a housing, each electrode having a connecting leg and an arcing horn running at an acute angle to the connecting leg, and the arcing horns of the electrodes having spaced facing surfaces between which the disruptive discharge-spark air gap is formed, wherein said disruptive discharge-spark air gap is curved or angled along an arcuate path of at least 10° and less than 180°.

14. Overvoltage protection element according to claim 13, wherein said arc is 90°.

15. Overvoltage protection element according to claim 13, wherein the arcing horn of a first of the two electrodes comprises a larger arcing horn and the arcing horn of the other of the two electrodes comprises a smaller arcing horn; wherein the larger arcing horn has a lower straight area which runs approximately at a right angle to the connecting leg of the first electrode and is joined to an arc-shaped upper area of the larger arcing horn; and wherein the smaller arcing horn has a lower straight area to which an arc-shaped upper area of the smaller arcing horn is joined.

16. Overvoltage protection element according to claim 15, wherein a lower area of the disruptive discharge-spark air gap encloses an angle of about 10° to 40°.

17. Overvoltage protection element according to claim 16, wherein the lower area of the disruptive discharge-spark air gap encloses an angle of about 20° to 30°.

18. Overvoltage protection element according to claim 15, wherein the lower straight areas of the arcing horns are joined to the upper areas of the arcing horns by a smoothly merging junction.

19. Overvoltage protection element according to claim 15, wherein a slot is provided on each lateral side of the housing, between the larger arcing horn and side walls of the housing.

20. Overvoltage protection element according to claim 13, wherein the disruptive discharge-spark air gap opens directly into a blow out opening of the housing.

21. Overvoltage protection element according to claim 20, wherein an arc splitter arrangement is located at least directly adjacent to the disruptive discharge-spark air gap.

22. Overvoltage protection element according to claim 21, wherein the arc splitter arrangement is located proximate the blow out opening.

23. Overvoltage protection element according to claim 21, wherein the arcing horn of a first of the two electrodes comprises a larger arcing horn and the arcing horn of the other of the two electrodes comprises a smaller arcing horn; wherein an uppermost arc splitter of the arc splitter arrangement is at a potential that is the same as that of the larger arcing horn and a lowermost arc splitter of the arc splitter arrangement has a potential that is the same as that of the smaller arcing horn.

24. Overvoltage protection element according to claim 23, wherein the width of larger arcing horn is smaller at least in the upper area than a width of the housing and wherein the housing has an exhaust gas opening on a side opposite the blow out opening.

25. An overvoltage protection element for discharging transient overvoltages of the type in which a disruptive discharge-spark air gap is active between two electrodes contained in a housing, each electrode having a connecting leg and an arcing horn running at an acute angle to the connecting leg, and the arcing horns of the electrodes having spaced facing surfaces between which the disruptive discharge-spark air gap is formed, wherein three arc splitter arrangements having a plurality of arc splitters is provided within said housing; wherein one of the arc splitter arrangements is located opposite ends of said arcing horns of the electrodes which are distant from the connecting legs; and wherein the other two of the arc splitter arrangements are each located on a side of a respective one of the two electrodes which faces away from the air gap between said two electrodes at a distance from the respective electrode.

* * * * *